US006067004A

United States Patent [19]

Hibayashi et al.

[11] Patent Number: 6,067,004

[45] Date of Patent: May 23, 2000

[54] HIGH CURRENT FUSE

[75] Inventors: Yasuko Hibayashi; Norio Matsumura, both of Shizuoka, Japan

[73] Assignee: Yazaki Corporation, Tokyo, Japan

[21] Appl. No.: 09/233,958

[22] Filed: Jan. 20, 1999

[30] Foreign Application Priority Data

Jan. 20, 1998 [JP] Japan ..... 10-008702

[51] Int. Cl.[7] ..... H01H 85/143; H01H 85/175; H01R 13/68

[52] U.S. Cl. ..... 337/227; 337/186; 337/231; 337/252; 439/622; 439/893

[58] Field of Search ..... 337/227, 186, 337/228, 231, 246, 248, 252; 29/623; 439/835, 893, 621, 622

[56] References Cited

U.S. PATENT DOCUMENTS

| | | | |
|---|---|---|---|
| 1,542,608 | 6/1925 | Bussmann | 337/290 |
| 4,158,187 | 6/1979 | Perreault | 337/248 |
| 4,563,809 | 1/1986 | Reeder | 29/623 |
| 4,656,453 | 4/1987 | Reeder | 337/236 |
| 4,837,546 | 6/1989 | Berstein | 337/272 |
| 5,229,739 | 7/1993 | Oh et al. | 337/290 |
| 5,235,307 | 8/1993 | Oh | 337/228 |

FOREIGN PATENT DOCUMENTS

| | | | |
|---|---|---|---|
| 2637846 | 4/1997 | Japan | H01H 85/08 |

*Primary Examiner*—Leo P. Picard
*Assistant Examiner*—Anatoly Vortman
*Attorney, Agent, or Firm*—Sughrue, Mion, Zinn, Macpeak & Seas, PLLC

[57] ABSTRACT

A fuse comprising first and second tab-shaped terminal plates, a fuse link, a first resin reinforcing member, a second resin reinforcing member. The fuse link is interposed between the first and second tab-shaped terminal plates. The first resin reinforcing member is for reinforcing a first boundary portion defined between the first tab-shaped terminal plate and the fuse link, and is integrally molded so as to cover the first boundary portion. The second resin reinforcing member is for reinforcing a second boundary portion defined between the second tab-shaped terminal plate and the fuse link, and the second resin reinforcing member is integrally molded so as to cover the second boundary portion.

10 Claims, 6 Drawing Sheets

HIGH CURRENT FUSE

BACKGROUND OF THE INVENTION

1. Field of the Invention

This invention relates to a fuse especially for high current used in an automobile.

2. Description of the Related Art

FIG. 11 shows a fuse for high current used in an automobile described in the related art (Japanese Patent Application No. Hei. 5-514966).

In FIGS. 11 and 12, a high current fuse 80 comprises a fusible fuse link 81, a pair of tab-like terminal plates 82 and a pair of covers 84 and 84. The fusible fuse link 81 is attached between the tab-like terminal plates 82, and through each of the terminal plates 82, mounting holes 83 are formed. The pair of covers 84 and 84 are fixedly secured to the terminal plates 82 to cover the fuse link 81. Each of the mounting holes 83 are fitted, for example, on a stud bolt 86 projecting from an equipment 85, and the fuse 80 is fixed to the stud bolts 86 by nuts 87 respectively.

However, since the two separate covers 84 are used, there has been a drawback that the fuse 80 is low in strength. Moreover, since the pair of covers 84 and 84 cover the fuse link 81, there has been a disadvantage that the condition of a fusible portion 81*a* (see FIG. 12) of the fuse link 81 can not be inspected with visual observation.

SUMMARY OF THE INVENTION

With the above problems in view, it is an object of this invention to provide a fuse for high current in which the strength of the fuse is enhanced, and also the condition of a fuse link can be inspected with visual observation.

The above object has been achieved by a fuse comprising first and second tab-shaped terminal plates, a fuse link, a first resin reinforcing member, a second resin reinforcing member. The fuse link is interposed between the first and second tab-shaped terminal plates. The first resin reinforcing member is for reinforcing a first boundary portion defined between the first tab-shaped terminal plate and the fuse link, and is integrally molded so as to cover the first boundary portion. The second resin reinforcing member is for reinforcing a second boundary portion defined between the second tab-shaped terminal plate and the fuse link, and the second resin reinforcing member is integrally molded so as to cover the second boundary portion.

In the above-mentioned fuse, it is preferable that the first and second reinforcing members are thicker than the first and second tab-shaped terminal plates, respectively.

It is also preferable that the first and second reinforcing members are integrally molded.

The above-mentioned fuse may further comprises a third reinforcing member extending in parallel with the fuse link and connecting the first and second reinforcing members, and the first to third reinforcing members are integrally molded.

In addition, the third reinforcing member may further comprise a pair of bridge members which define a square shape together with the first and second reinforcing members.

In the above-mentioned fuse, it is further preferable that a transparent cover is attached to at least one of the first, second and third, if comprised, reinforcing members.

DETAILED DESCRIPTION OF THE PREFERRED EMBODIMENTS

Figure 1:
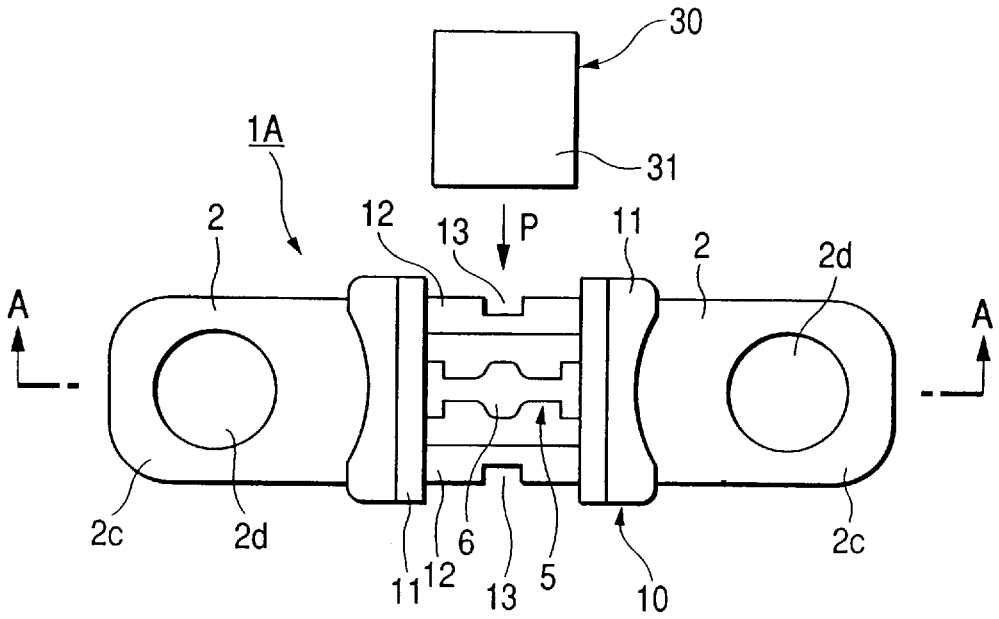
FIG. 1 is a plan view of one preferred embodiment of a high current fuse according to the present invention.
Figure 2:
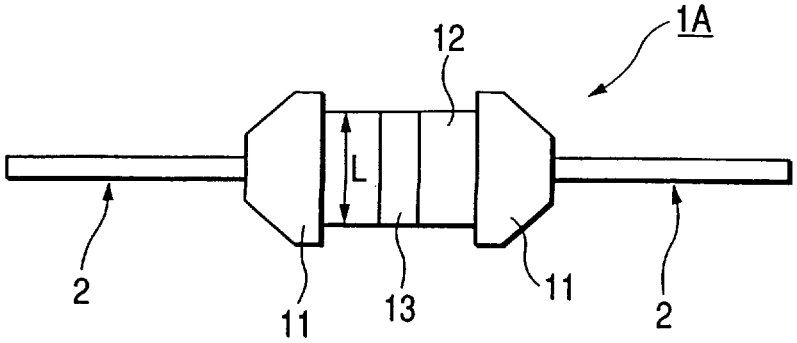
FIG. 2 is a front view of the fuse of FIG. 1.
Figure 3:
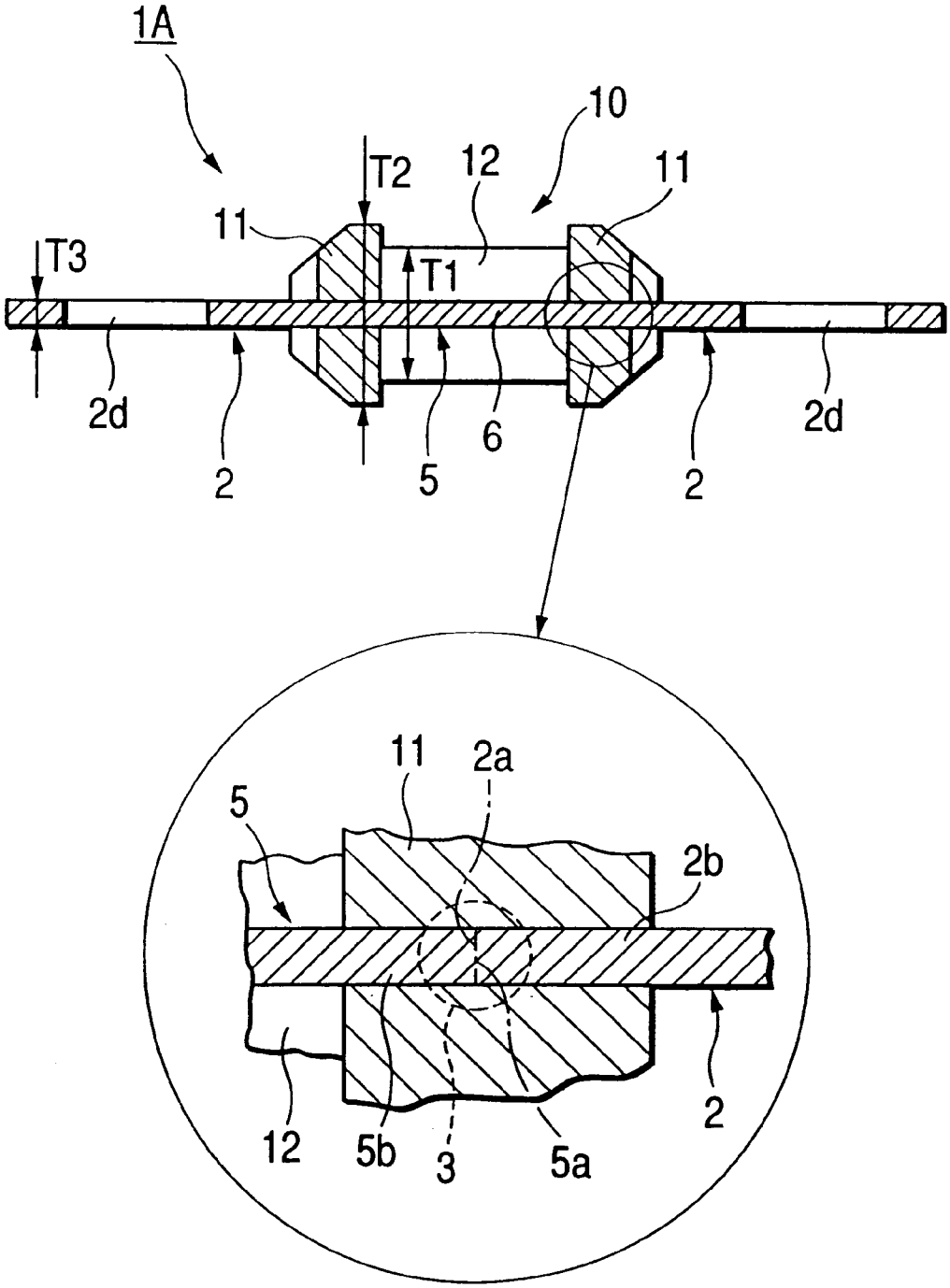
FIG. 3 is a cross-sectional view taken along the line A—A of FIG. 1.
Figure 4:
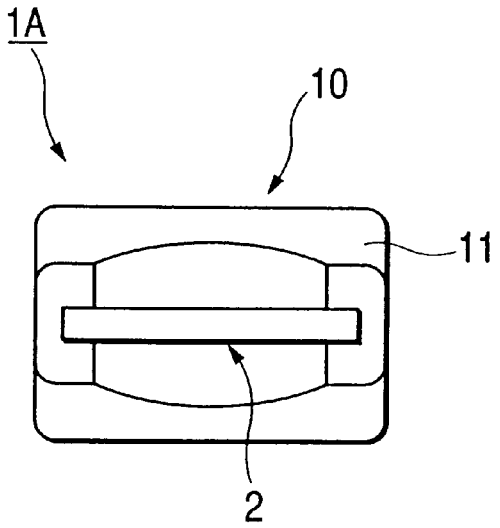
FIG. 4 is a side view of FIG. 2.

A preferred embodiment of the present invention will now be described with reference to the drawings.

FIGS. 1 to 10 show a preferred embodiment of a high current fuse of the present invention.

In FIGS. 1 to 4, a high current fuse (hereinafter referred to as "fuse") 1A comprises a pair of tab-like terminal plates 2 and 2, a frame-like reinforcement member 10, a transparent cover 30. A fusible fuse link 5 is integrally attached at each end 2a of the terminal plates 2 and 2, and the ends 2*a* are opposite to each other. The frame-like reinforcement member 10 is integrally molded on end portions 2*b* of the terminal plates 2 and 2, which is opposite to each other. A transparent cover 30 is attached to the reinforcement member 10.

Ends 5*a* and 5*a* of the fuse link 5 are integrally connected with the ends 2*a* respectively at substantially central portions of the terminal plates 2. In this integrally-connected condition, the fuse link 5 is disposed in line with the pair of terminal plates 2 and 2 (see FIG. 3). A fusible portion 6 is provided at a central portion of the fuse link 5, and this fusible portion 6 can be melted by heat generated in the fuse.

A mounting hole 2*d* for the passage of a screw, a bolt or the like (not shown) therethrough is formed through end portion 2*c* of each of the terminal plates 2 and 2, which are the end portions other than the ends 2*a*.

The reinforcement member 10 is made of a resin, and has a substantially square-frame configuration. The reinforcement member 10 comprises a pair of thickened portions 11 and 11 and a pair of bridge portions 12 and 12. The thickened portions 11 and 11 are integrally molded to cover end portions 5*b* of the fuse link 5, respectively, and a pair of bridge portions 12 and 12 are extending between the thickened portions 11. Thickness T2 of the thickened portions 11 and Thickness T1 of the bridge portions 12 are much greater than Thickness T3 of the terminal plates 2. (See FIG. 3)

The thickened portions 11 are integrally molded to respectively cover a portion 3 of connection between the end 5*a* of the fuse link 5 and the end 2*a* of the terminal plate 2 between each pair of the fuse links 5 and the terminal plates 2. Therefore, the strength of the connection portions 3 is higher as compared with the construction referred as the related art (see FIGS. 1 and 3). As a result, the strength is increased in a direction intersecting a longitudinal axis of the fuse link 5. Moreover, the pair of bridge portions 12 and 12 are provided parallel to the longitudinal axis of the fuse link 5, and extend to be disposed respectively on the side of the end 5*a* of the fuse link 5. Therefore, the strength of the fuse link 5 in its longitudinal direction is also increased (see FIG. 1). Namely, the fuse link 5 is surrounded on four sides by the pair of thickened portions 11 and 11 and the bridge portions 12 and 12. Therefore, the strength of the fuse 1A is higher as compared with the construction references as the related art.

A retaining groove 13 of a U-shaped cross-section is molded in an outer surface of each of the bridge portions 12 in a direction intersecting the longitudinal axis of the fuse link 5.

Figure 5:
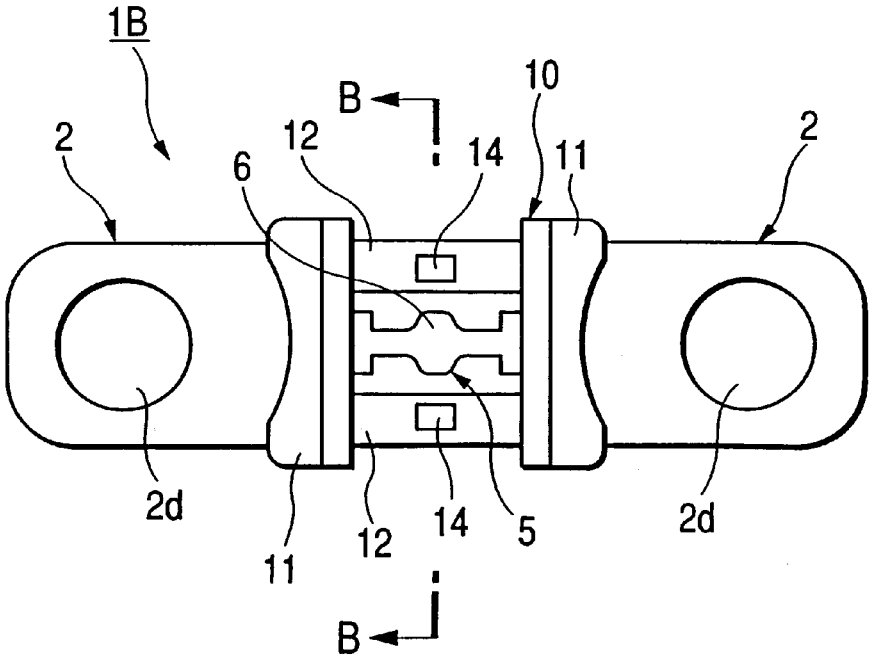
FIG. 5 is a plan view showing another embodiment.
Figure 6:
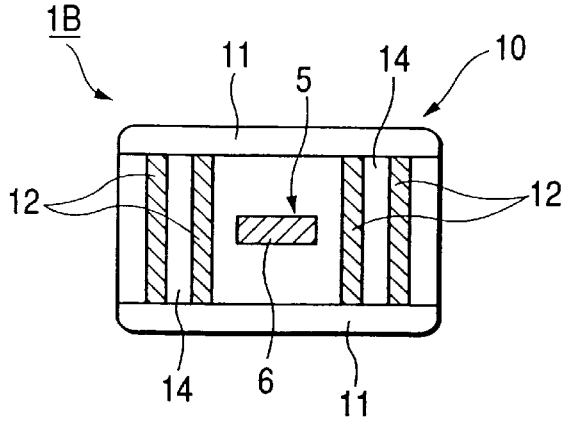
FIG. 6 is a cross-sectional view taken along the line B—B of FIG. 5.

FIGS. 5 and 6 show a modified fuse 1B in which instead of the cross-sectionally U-shaped retaining groove 13 (see FIG. 1), a retaining hole 14 is molded in each bridge portion 12.

Figure 7:
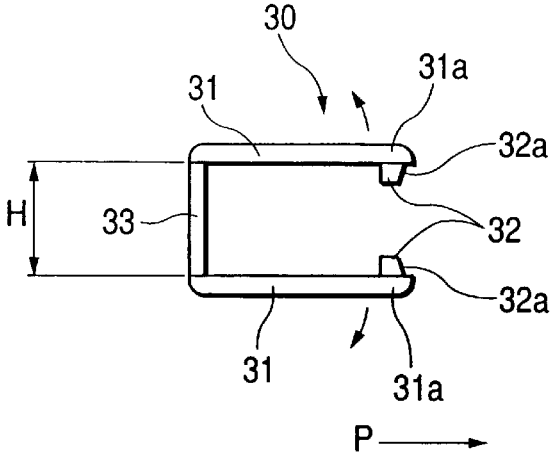
FIG. 7 is a side view of a transparent cover of FIG. 1.
Figure 8:
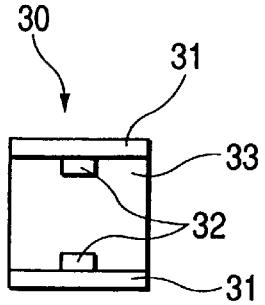
FIG. 8 is a front view of FIG. 7.

As shown in FIGS. 7 and 8, the transparent cover 30 is made of a resin, and has a U-shaped cross-section. A pair of side wall plates 31 and 31, opposite to each other, of the transparent cover 30 have elasticity, and a pair of opposed retaining projections 32 are formed respectively on inner surfaces of free ends 31*a* of the side wall plates 31. The transparent cover 30 also has an operating plate 33 extending between the pair of side wall plates 31 and 31. A tapered surface 32*a* is formed on each retaining projection 32 and tilting in the direction which intersects the axis along an attaching direction, direction P in FIG. 7. The transparent cover 30 is attached to the reinforcement member 10 (and hence to the fuse 1A) across the fuse link 5, with the retaining projections 32 engaged in the retaining groove 13. Since the pair of side wall plates 31 and 31 of the transparent cover 30 are transparent, the fuse link 5 can be directly inspected with visual observation through the side wall plate 31. Therefore, the condition of the fusible portion 6 of the fuse link 5 can be confirmed at a glance.

The pair of side wall plates 31 and 31 are disposed symmetrically, and therefore the transparent cover 30 can be easily attached to the reinforcement member 10 even if either of the side wall plates 31 is disposed at the upper side, and besides the condition of the fuse link 5 can be positively inspected with visual observation. Further, a length (height) H of the operating plate 33 is slightly longer than a height L of the bridge portions 12 (see FIG. 2).

Figure 9:
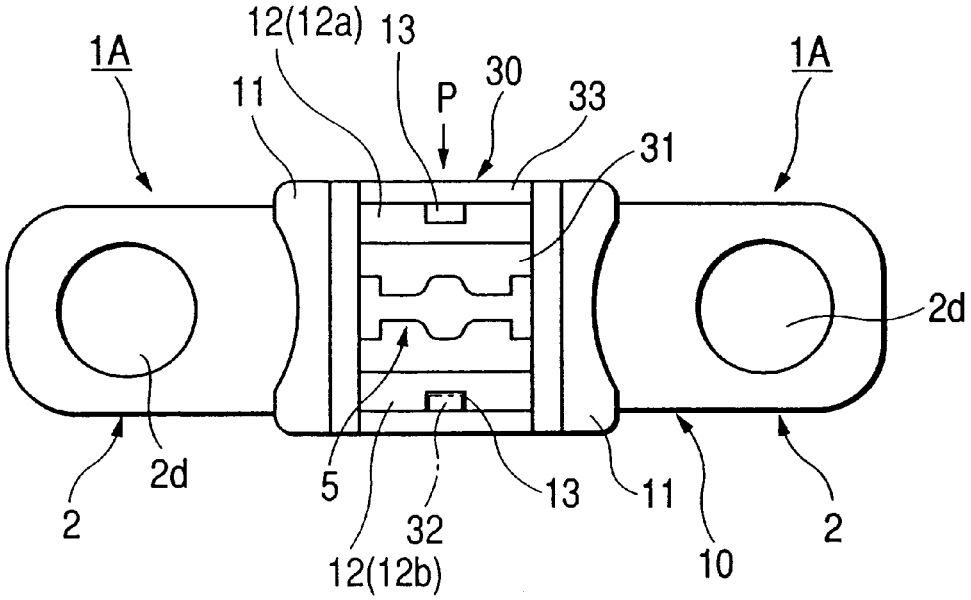
FIG. 9 is a plan view showing a condition in which the transparent cover is attached to the high current fuse of FIG. 1.

When the operating plate 33 of the transparent cover 30 of FIG. 7 is pushed in the direction P, the retaining projections 32 (see FIGS. 7 and 8) on the transparent cover 30 are brought into engagement with a bridge portion 12*a* of the reinforcement member 10 as shown in FIG. 9. When the tapered surfaces 32*a* slide over the one bridge portion 12*a*, the pair of side wall plates 31 and 31 are elastically flexed respectively in directions opposite to each other (indicated by arrows to upper and lower in FIG. 7). After then, the pair of side wall plates 31 and 31 are restored. The retaining projections 32 will not contact the fuse link 5 during the time when the retaining projections 32 are moved into engagement with the other bridge portion 12*b*, and therefore fuse link 5 will not be damaged.

Figure 10:
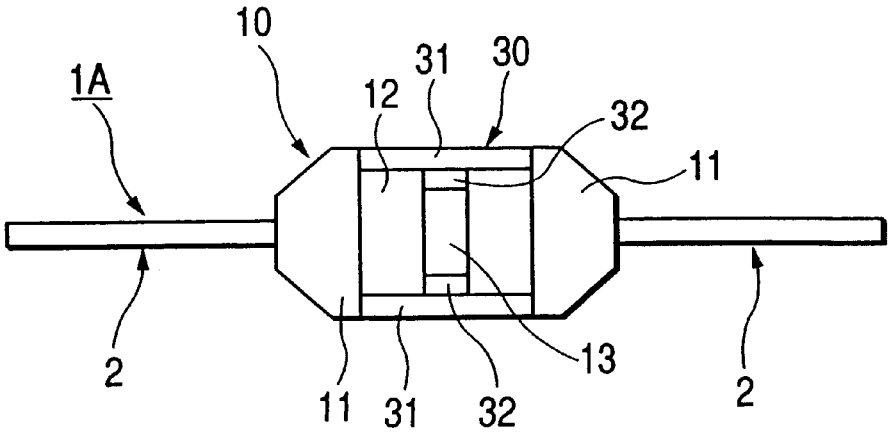
FIG. 10 is a front view of FIG. 9.
Figure 11:
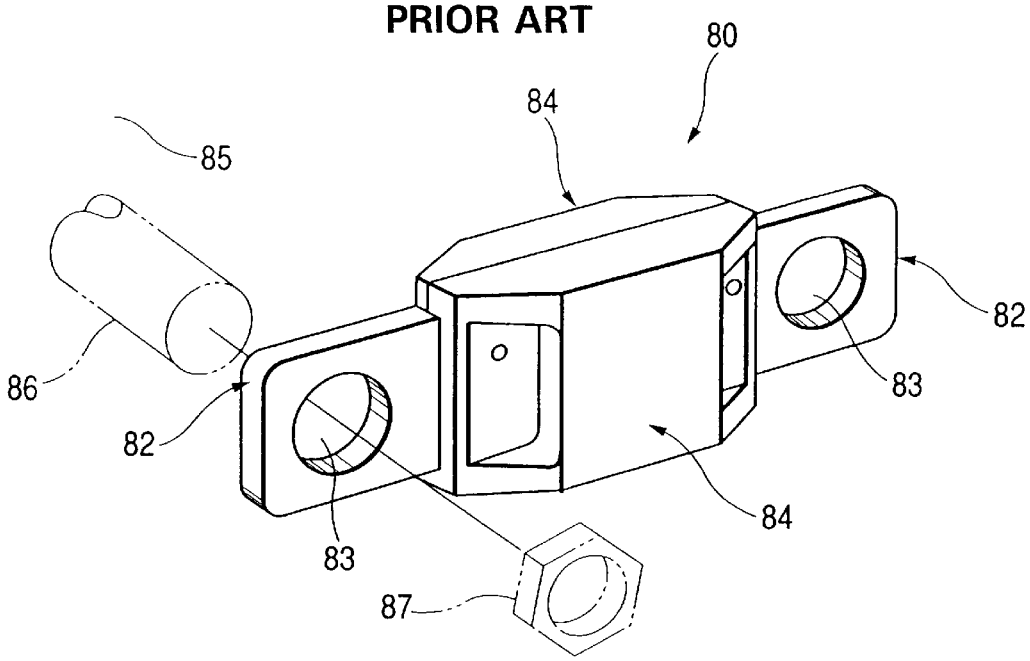
FIG. 11 PRIOR ART
FIG. 11 is a perspective view of a conventional fuse.
Figure 12:
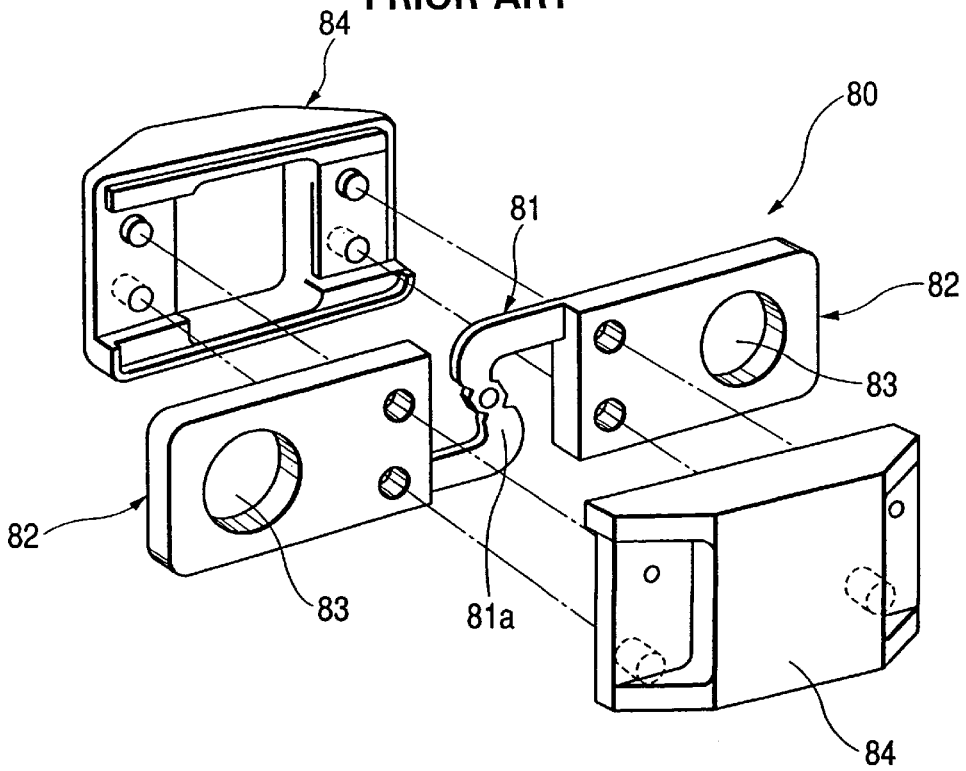
FIG. 12 PRIOR ART
FIG. 12 is an exploded view of the fuse of FIG. 11.

When the retaining projections 32 abut against the other bridge portion 12*b*, the pair of side wall plates 31 and 31 are again elastically deformed away from each other by the other bridge portion 12*b*. When the retaining projections 32 slide over the other bridge portion 12*b*, the two side wall plates 31 and 31 are elastically restored, so that the retaining projections 32 are engaged in the retaining groove 13 molded in the other bridge portion 12*b*, as shown in FIG. 10. As described above, the retaining grooves 13 are molded respectively in the pair of bridge portions 12 and 12, and therefore the fusible portion 6 of the fuse link 5 can be inspected with visual observation through the side wall plate 31 even if either of the two side wall plates 31 is disposed at the upper side.

As described above, according to the present invention, the reinforcement member, made of a resin, is integrally molded in surrounding relation to the fuse link, and therefore the strength of the fuse is increased.

Furthermore, the pair of thickened portions of the reinforcement member are integrally molded respectively on the portions of connection between end portions of the fuse link and end portions of the terminal plates. Therefore, the portions of connection are covered with the thickened portions, respectively, and the strength of the connection potions is higher as compared with a construction according to the related art.

Furthermore, the pair of bridge portions of the reinforcement member are integrally molded to extend between the thickened portions without interference with the fuse link, and therefore the strength of the fusible link in its longitudinal direction is increased.

Accordingly, the fuse link is surrounded on four sides by the thickened portions and bridge portions which are made of a resin, and therefore the fuse has a higher strength as compared with the conventional construction.

The transparent cover is attached to the reinforcement member to cover the fuse link, and therefore the condition of the fuse link can be inspected positively and easily with visual observation through the transparent cover.

In addition, the transparent cover has a U-shaped cross-section, and the transparent cover is attached to the reinforcement member across the fuse link. Therefore, the transparent cover can be attached from either side with respect to the fuse link. Moreover, the direction of attaching of the transparent cover is not limited.

Thus, according to the present invention, the strength of the fuse is increased, and besides the condition of the fuse link can be easily confirmed through the transparent cover. Therefore, the durability of the fuse is enhanced, and also the defective fuse link in the fuse can be eliminated. Hence, the reliability of the produced fuse is much enhanced as compared with the product according to the related art.

The present invention is based on Japanese Patent Application No. Hei. 10-8702, which is incorporated herein by reference.

While only certain embodiments of the invention have been specifically describe herein, it will be apparent that numerous modification may be made thereto without departing from the spirit and scope of the invention.

What is claimed is:

1. A fuse comprising:

first and second tab-shaped terminal plates;

a fuse link interposed between said first and second tab-shaped terminal plates;

a first resin reinforcing member for reinforcing a first boundary portion defined between said first tab-shaped terminal plate and said fuse link, said first resin reinforcing member being integrally molded with said first boundary portion so as to enclose said first boundary portion; and a second resin reinforcing member for reinforcing a second boundary portion defined between said second tab-shaped terminal plate and said fuse link, said second resin reinforcing member being integrally molded with said second boundary portion so as to enclose said second boundary portion.

2. The fuse according to claim 1, wherein said first and second reinforcing members are thicker than said first and second tab-shaped terminal plates, respectively.

3. The fuse according to claim 1, wherein said first and second reinforcing members are integrally molded.

4. The fuse according to claim 1, further comprising:

a third reinforcing member extending in parallel with said fuse link and connecting said first and second reinforcing members, in which said first to third reinforcing members are integrally molded.

5. The fuse according to claim 4, wherein said third reinforcing member comprises a pair of bridge members which define a square shape together with said first and second reinforcing members.

6. The fuse according to claim 1, further comprising:

a transparent cover attached to at least one of said first and second reinforcing members.

7. The fuse according to claim 2, further comprising:

a transparent cover attached to at least one of said first and second reinforcing members.

8. The fuse according to claim 3, further comprising:

a transparent cover attached to at least one of said first and second reinforcing members.

9. The fuse according to claim 4, further comprising:

a transparent cover attached to at least one of said first, second and third reinforcing members.

10. The fuse according to claim 5, further comprising:

a transparent cover attached to at least one of said first, second and third reinforcing members.

* * * * *